United States Patent [19]

Uemura et al.

[11] 4,438,193

[45] Mar. 20, 1984

[54] SILVER HALIDE PHOTOSENSITIVE COLOR PHOTOGRAPHIC MATERIAL

[75] Inventors: Morito Uemura; Kenichi Kishi; Satoshi Nakagawa; Shuji Kida, all of Hino, Japan

[73] Assignee: Konishiroku Photo Industry Co., Ltd., Tokyo, Japan

[21] Appl. No.: 332,962

[22] Filed: Dec. 21, 1981

[30] Foreign Application Priority Data

Dec. 27, 1980 [JP] Japan ..... 55-188974

[51] Int. Cl.[3] ..... G03C 1/46; G03C 7/26

[52] U.S. Cl. ..... 430/505; 430/544; 430/548; 430/553; 430/555; 430/557; 430/558

[58] Field of Search ..... 430/544, 548, 553, 555, 430/557, 558, 505

[56] References Cited

U.S. PATENT DOCUMENTS

| | | | |
|---|---|---|---|
| 2,706,683 | 4/1955 | Sawdey | 430/548 |
| 3,476,563 | 11/1969 | Loria | 430/548 |
| 3,930,866 | 1/1976 | Oishi et al. | 430/558 |
| 4,283,472 | 8/1981 | Gompf et al. | 430/555 |
| 4,310,618 | 1/1982 | Fernandez et al. | 430/557 |

*Primary Examiner*—J. Travis Brown

*Attorney, Agent, or Firm*—Frishauf, Holtz, Goodman & Woodward

[57] ABSTRACT

There is disclosed a novel silver halide photosensitive color photographic material comprising a coupler which consists of a coupling component (A) which is capable of causing a coupling reaction with an oxidized color developing agent and a substituent component bonded at the coupling position of said coupling component (A), which substituent component is capable of being split off on coupling reaction, the improvement characterized in that said substituent comprises a coupling component (B) which can undergo coupling reaction with an oxidized color developing agent when released from said coupling component (A) and a photographically useful component which is capable of being released on coupling reaction of said coupling component (B).

The color photographic material according to the present invention provides graininess, sharpness and color reproducibility which is sufficiently competent to the requirement of further miniturization of film size by use of a coupler having novel functions.

9 Claims, No Drawings

SILVER HALIDE PHOTOSENSITIVE COLOR PHOTOGRAPHIC MATERIAL

This invention relates to a silver halide photosensitive color photographic material containing a coupler for photography having novel functions.

It has heretofore been practiced to impact photographically useful performances or functions by the introduction of various substituents at the position at which a coupler can react with an oxide of a color forming developing agent (this position is hereinafter called as active site). For example, by forming a so-called di-equivalent coupler, in which a readily releasable, photographically deleterious group is bonded to the active site, coupling capability can be enhanced and the quantity of silver necessary for obtaining dyestuff images can be reduced to ½, and consequently, the emulsion layer can be made thinner with improvement of sharpness. A so-called colored coupler having a dye bonded to the active site also enables color correction of dyestuff photographic images. Further, a so called DIR coupler having a development inhibitor bonded to the active site has the function of control of image tone, micropulverization of dyestuff images and interlayer effect. As a matter of course, it has also been attempted to bond other photographically useful substituents to the active site.

To make a general survey on the trend of color photographic technology, there are two marked trends, even limited within these ten years. One is migration of film sizes to smaller sizes, while the other is high sensitization. More specifically, the former is migration from 135 size to 110 size, while the latter is migration from ASA sensitivity 50 via ASA sensitivity 100 to ASA sensitivity 400. Migration of film size to smaller sizes results not only in saving of silver which is on the way to being exhausted but also in realization of miniturization of cameras, thus providing so-called pocket cameras handy in use and convenient for carrying. High sensitization enables supply of color prints at lower costs by increasing productivity per unit time in color printing papers, while it enables photographing in dark places without use of an auxiliary light source such as flash or a stroboscope.

However, a film of 110 size is not yet satisfactory in its graininess, color reproducibility and sharpness, and accordingly, it cannot answer to the requirement of further miniaturization of film size at all. In case of a film with ASA sensitivity 400, the image quality is inferior to a film with ASA sensitivity 100 as an undeniable fact due to the basic property of the silver halide photography that silver halide grains become greater with the increase of sensitivity.

For improvement of such drawbacks, there have been proposed various methods. The aforementioned DIR coupler or colored coupler is one of them. As other methods, there are thin film formatiom of photosensitive emulsion layer, separation of the same wavelength region photosensitive layer into a high sensitive silver halide layer and a low sensitive silver halide layer, improvement of silver halide preparation technique, halation prevention technique, improvement of irradiation prevention technique, etc. But each of these methods is still unsatisfactory, and it would be desirable to have a further improved technique.

The object of the present invention is to provide a silver halide color photographic photosensitive material having graininess, sharpness and color reproducibility sufficient competent to permit of further miniaturization of film size by use of a coupler having novel functions.

The present inventor has made extensive studies about the coupler structure influencing upon graininess, sharpness and color reproducibility. As a consequence, a certain kind of coupler was found to be capable of achieving the above object. That is, the above object can be accomplished by a silver halide photosensitive color photographic material comprising a coupler which consists of a coupling component (A) which is capable of causing a coupling reaction with an oxidized color developing agent and a substituent component bonded at the coupling position of said coupling component (A), which substituent component is capable of being split off on coupling reaction, in which that said substituent comprises a coupling component (B) which can undergo a coupling reaction with an oxidized color developing agent when released from said coupling component (A) and a photographically useful component which is capable of being released on coupling reaction of said coupling component (B).

The desirable coupler for photography for the present invention is represented by the formula [I]:

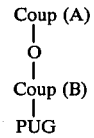

Formula [I]

wherein Coup (A) represents a coupling component (A) and Coup (B) a coupling component (B), Coup (A) being bonded to the oxygen atom O at the position capable of forming a colored or a colorless compound through coupling with an oxidized form of a color forming developing agent, Coup (B) being bonded to the oxygen atom in the form such that it can be made for the first time capable of coupling with an oxide of a color forming developing agent by being released from Coup (A) upon coupling of Coup (A), and PUG being bonded at the position capable of coupling with an oxide of a color forming developing agent of Coup (B) and in the form such that it can be released from Coup (B) by said coupling.

The mechanism of action of the coupler for photography represented by the formula [I] is schematically illustrated below:

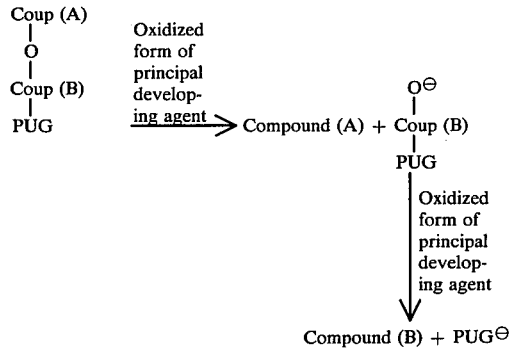

wherein Coup (A), Coup (B) and PUG are the same as defined in the formula [I]; Compound (A) and Compound (B) are products formed by coupling of Coup (A) and Coup (B), respectively, with an oxidized form of a developing agent.

As the coupling component (A) and the coupling component (B) of the present invention, there may generally be employed residues of yellow, cyan and magenta couplers conventionally used for silver halide photographic photosensitive materials. Among them, there are included those which can form colorless compounds through coupling with an oxidized form of a color forming developing agent and also those which can form colored compounds. Examples of those capable of forming colorless compounds through coupling are acetophenone derivative residues and indanone derivative residues, while those capable of forming colored compounds through coupling may include various residues of couplers as enumerated below.

So far as yellow couplers are concerned, there may be mentioned benzoyl acetoanilide type yellow couplers or pivaloyl acetoanilide type yellow couplers as disclosed in U.S. Pat. Nos. 2,298,443; 2,407,210; 2,875,057; 3,048,194; 3,265,506 and 3,447,928, and "Farbkuppler-eive Literaturubersicht" Agfa Mitteilung (Band II), p. 112–126 (1961). As for magenta couplers, there are various magenta couplers such as pyrazolone type magenta couplers, indazolone type magenta couplers, as disclosed in U.S. Pat. Nos. 2,369,489; 2,343,703; 2,311,082; 2,600,788; 2,908,573; 3,062,653; 3,152,896; and 3,519,429, and the aforesaid literature Agfa Mitteilung (Band II) p. 126–156 (1961).

Further, in case of cyan couplers, there are naphthol type of phenol type couplers as disclosed in U.S. Pat. Nos. 2,367,531; 2,423,730; 2,474,293; 2,772,162; 2,895,826; 3,002,836; 3,034,892; and 3,041,236, and the aforesaid literature Agfa Mitteilung (Band II) p. 156–175 (1961).

As a photographically useful group PUG, there may be employed any group which can cause a photographically advantageous effect in a photographic element.

Typical examples of photographically useful groups may include development inhibitors, development accelerators, bleaching inhibitors, bleaching accelerators, developing agents, fixing agents, silver halide solvents, silver-complex forming agents, film hardeners, tanning agents, color controllers, fogging agents, fogging preventives, chemical or chemical sensitizers, desensitizers, dyestuffs for photography or precursors thereof, couplers (e.g. competing coupler, color forming coupler, development inhibitor-releasing coupler, i.e. DIR-coupler), etc.

Among these photographically useful groups, development inhibitors are most preferred. Typical examples may include mercaptotetrazole group, selenotetrazole group, mercaptobenzothiazole group, selenobenzothiazole group, mercaptobenzoxazole group, selenobenzoxazole group, mercaptobenzimidazole group, selenobenzimidazole group, benzotriazole group, benzodiazole group and iodine atoms as disclosed in U.S. Pat. Nos. 3,227,554; 3,384,657; 3,615,506; 3,617,291; and 3,733,201, and U.K. Pat. No. 1,450,479.

More preferably, in the formula [I], the moiety excluding Coup (A) may be a diffusible compound residue.

In the following, there are enumerated typical examples of the present invention, but the present invention is not limited thereto.

Compound-1

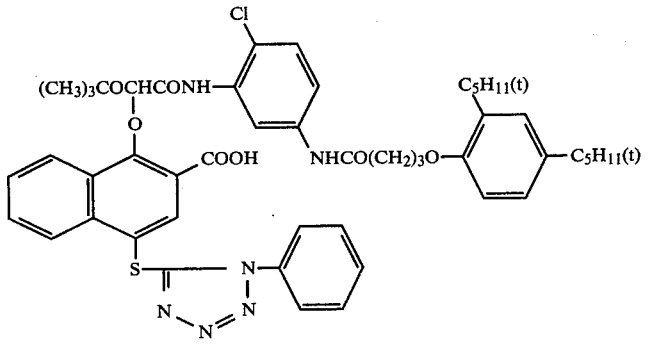

Compound-2

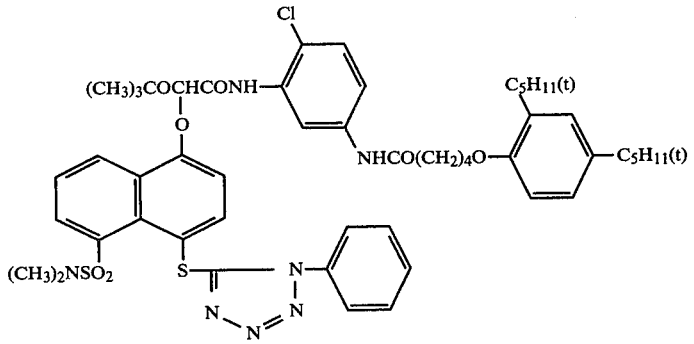

-continued
Compound-3
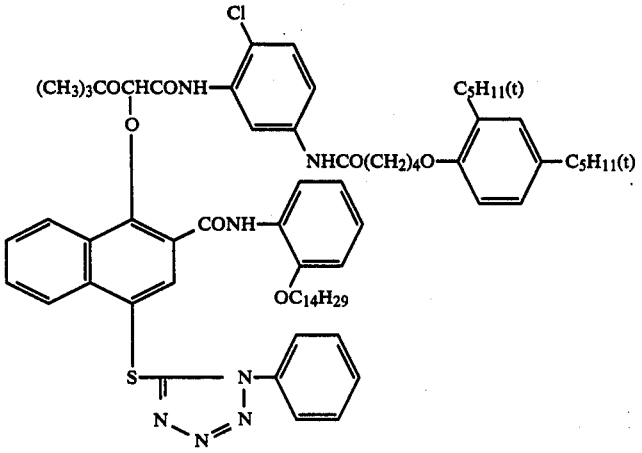
Compound 4
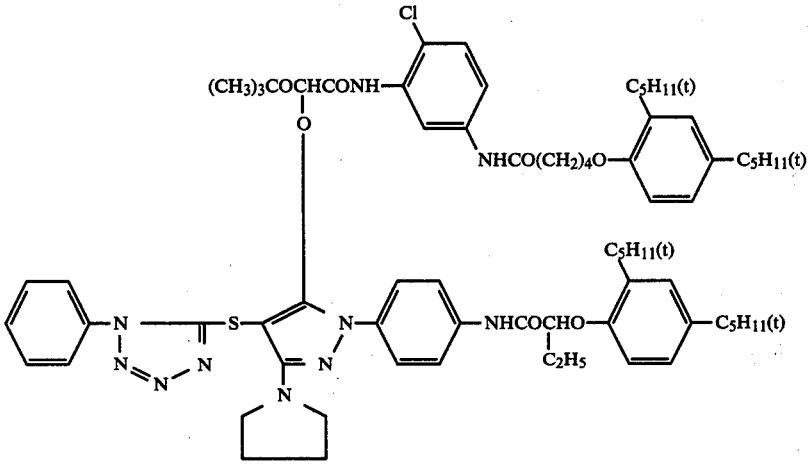
Compound-5
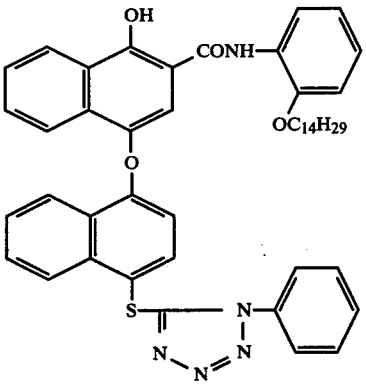

-continued
Compound-6
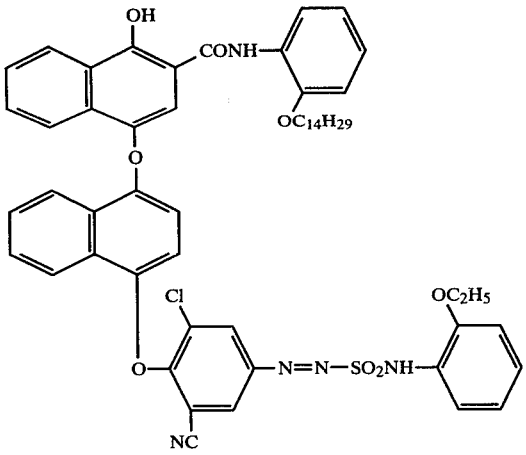
Compound-7
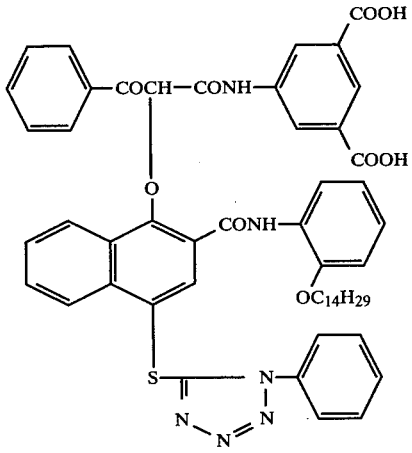
Compound-8
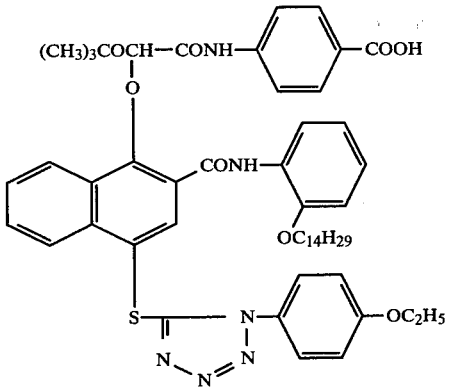
Compound-9
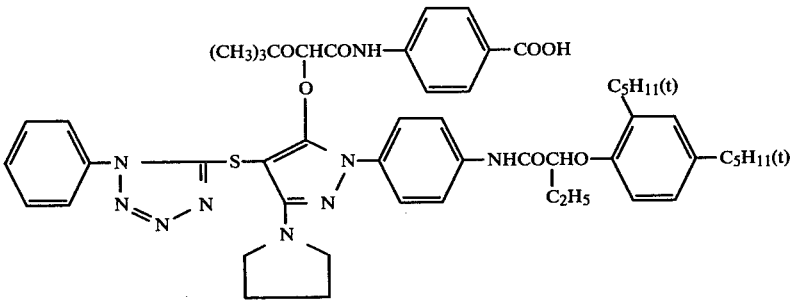

-continued

Compound-10

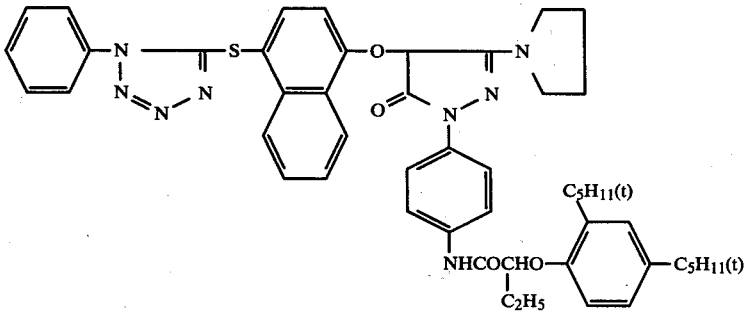

Compound-11

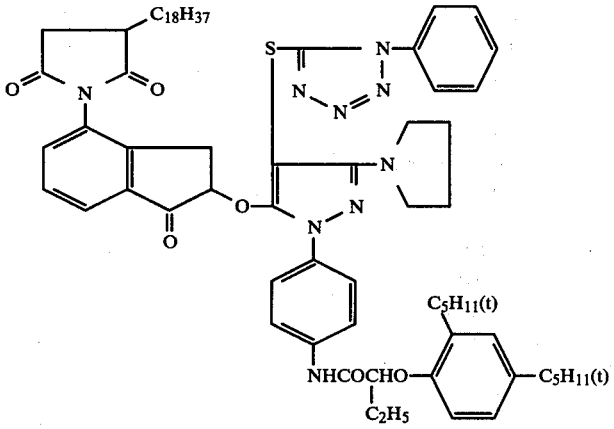

Synthesis examples of typical compounds of the present invention are shown below, but other compounds can also similarly be synthesized.

(Synthesis example)

Synthesis of exemplary compound-1

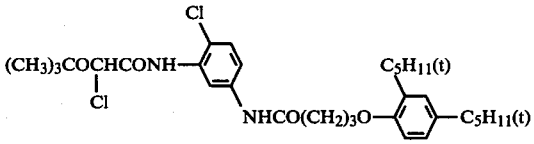

(I)

+

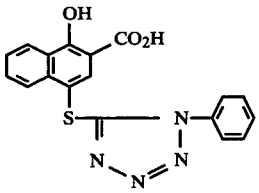

(II)

↓

Exemplary compound-1

A mixture of 6 g of (I), 3.7 g of (II) and 1.5 g of triethylamine was boiled in acetonitrile for 3 hours and left to cool to room temperature. Then, the crystals formed were collected and washed with water and alcohol. After air drying, 5.5 g of pale yellow crystals were obtained. m.p. 198° C.–200° C.; confirmed by mass spectrum and NMR.

Synthesis of exemplary compound-2

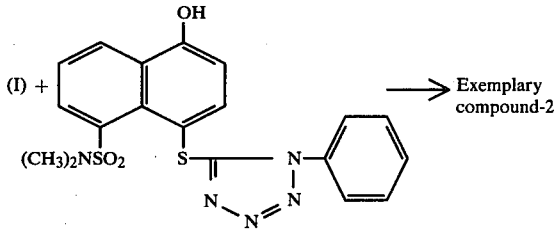

(III)

The compound (III) (4.3 g) was dissolved in 30 ml of DMF and 0.5 g of NaH was added to the resulting solution under stirring. After foaming stopped, 6.0 g of (I) was added to the mixture, followed by stirring at room temperature for 3 hours. The reaction mixture was poured into a dil. aqueous hydrochloric acid, and the crystals formed were collected and dried on air. The yellow crystals were dissolved in a small quantity of benzene and subjected to silica gel chromatography using benzene-acetone as eluant thereby to separate the objective phase. As a result, 3.2 g of pale yellow crystals were obtained. m.p. 45° C.–48° C.; confirmed by mass spectrum and NMR.

For the same purpose as that of the present invention, there is disclosed in U.K. Pat. No. 1,546,837 a coupler having a non-diffusion type coupler and a diffusion type coupler bonded at both active sites thereof through a methylene group. When these compounds were tested using a highly sensitive silver halide emulsion, there was observed substantially no improvement with respect to graininess and sharpness. Perhaps, this may be because of the slow coupling reaction between the color forming developing agent or split-off of the bonding at the active sites due to the carbon-carbon bonding at the active sites of the compound as disclosed in said U.K. Patent, on one hand, and also because of two active sites possessed by this compound which make it difficult to control invariably the order of couplings, on the other. In contrast, the compound of the present invention can undergo rapid coupling and split-off due to carbon-oxygen bonding at the active site, and the group released by the coupling in the first step in turn undergoes the second step coupling with an oxide of a color forming developing agent existing in an excess, and further PUG is released by said coupling. Thus, by removal of excessively existing oxides of color forming developing agent, enlargement of color forming dyestuffs can be avoided thereby to enhance graininess and further improve photographic performance with PUG depending on its function.

There are also disclosed compounds similar to the present invention in Research Disclosure, No. 19536, July, 1980 and also in the same Journal, No. 19633, August, 1980. The compounds disclosed in these literatures have non-diffusion type couplers bonded through oxygen atom to the active sites of diffusion-type couplers. As the result of the tests of these compounds, it was found that improvement of sharpness was still far from satisfactory, although graininess can be improved to a considerable extent. When they were added in amounts sufficient to achieve the object, there was observed lowering in sensitivity. This may be considered to be due to the fact that the color forming developing agent is itself oxidized through reduction of exposed silver halide and the color forming dyestuff formed during this process by coupling with the oxide of the color forming developing agent is a diffusion type and therefore washed away out of the film system, whereby the oxide of the color forming developing agent at the initial stage of development, having influence on sensitivity, is superfluously consumed. In contrast, the compound of the present invention can further enhance graininess by release of PUG, for example, by release of a small quantity of a development inhibitor. Since a development inhibitor can exhibit a great effect in a small quantity, there was obtained a surprising result that its quantity could sufficiently be several times to some ten times smaller than the compounds disclosed in the aforesaid Research Disclosure. In addition, when the moiety excluding Coup (A) in the formula [I] is a diffusion type, it is diffused to other layers, wherein PUG is released, thus effecting so-called interlayer effect thereby to further provide an unexpected effect of improving color reproducibility.

In U.K. Pat. No. 1,077,874, and U.S. Pat. Nos. 3,476,563 and 3,644,498, there are disclosed couplers having an aryl group bonded through oxygen atom at the active site of coupler. In the couplers disclosed in these Patents, the -O-aryl group released by coupling with an oxide of a principal color forming developing agent is a coupler which can no longer undergo substantial coupling with an oxide of a principal color forming developing agent. Therefore, it has no function to improve graininess and sharpness as possessed by the compound of the present invention. Besides, these effects of the present invention cannot be expected at all from the disclosure of such a coupler.

Further, Japanese Provisional Patent Publication 145135/1979 discloses a compound having timing which can exhibit the same effect as the present invention. But, any of the compounds disclosed in said Patent Publication is prepared from a lengthy synthetic route. Moreover, it suffers from lowering in sensitivity through decomposition during storage. In contrast, the compound of the present invention can be synthesized easily and is substantially free from decomposition during storage.

The coupler for photography according to the present invention can be dispersed in a silver halide photosensitive photographic material by the method well known among those skilled in the art. The optimum amount to be added can easily be determined by a simple preliminary test. As the principal color forming developing agent, there may be employed one selected from those known in the art of this field. There may also be employed various conventionally used additives in the silver halide photosensitive color photographic material.

The silver halide photosensitive color photographic material can include a support and, applied on said support, a red sensitive silver halide emulsion unit in which substances for forming cyan dyestuff images are combined, a green sensitive silver halide emulsion unit in which substances for forming magenta dyestuff images are combined and a blue sensitive silver halide emulsion unit in which substances for forming yellow dyestuff images are combined. Further, each of these silver halide emulsion units may be constituted of one or more layers. Also, various units and layers may be arranged at places different from each other.

The preferred embodiments of the present invention are illustrated with reference to the following examples, by which the present invention is not limited.

EXAMPLE 1

An emulsion was prepared by mixing a solution of 10.7 g of α-pivaloyl-α-(2,5-dioxo-3,4-diphenylimidazolidine-1-yl)-2-chloro-5-[γ-(2,4-di-tert-amylphenoxy)-butylamido]acetoanilide dissolved in 11 ml of tricrysyl phosphate and 30 ml of ethyl acetate with 20 ml of an aqueous 10% solution of Alkanol B (alkylnaphthalene sulfonate, produced by Du Pont de Nemours & Co.) and 200 ml of an aqueous 5% gelatin solution, followed by emulsifying dispersion in a colloid mill. The dispersion was added to 1 kg of a high sensitivity silver iodobromide emulsion (containing 7 mole% of silver iodobromide), and 40 ml of an aqueous 2% solution of 1,2-bis(vinylsulfonyl)ethane was added as film hardener thereto. The thus prepared composition was coated on a support of a cellulose triacetate film which had been subjected to undercoating processing (coated silver quantity 12 mg/100 $cm^2$, coupler mole/Ag mole=0.05).

The thus prepared silver halide photosensitive color photographic material is referred to as Sample 1.

Samples 2, 3 and 4 were prepared by incorporating the Compound-2, the Compound-3 and the Compound-4 according to the present invention in the emulsion layer of Sample 1, respectively. Comparative samples 1, 2 and 3 were also prepared by adding the following comparative compounds to Sample 1, respectively.

Comparative compound-1

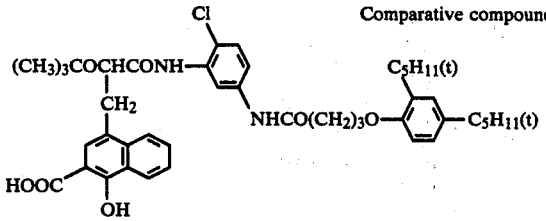

A compound as disclosed in U.K. Patent No. 1,546,837

Comparative compound-2

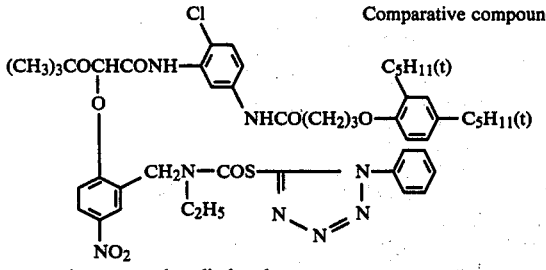

A compound as disclosed in Japanese Provisional Patent Publication No. 145135/1979

Comparative compound-3

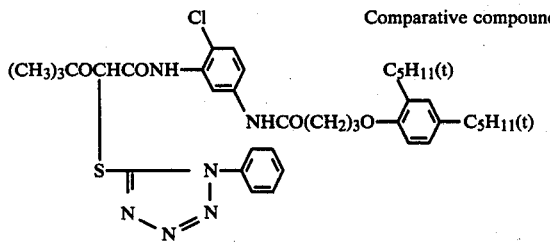

DIR coupler of prior art

Each of these samples was subjected to wedge exposure to light by an intensity scale photosensitometer, and thereafter color forming developing treatment was applied according to the following steps to obtain the results as shown in Table 1.

| Treatment steps (38° C.) | Treatment time |
|---|---|
| Color forming development | 3 min. 15 sec. |
| Bleaching | 1 min. 30 sec. |
| Washing with water | 3 min. 15 sec. |
| Fixation | 6 min. 30 sec. |
| Washing with water | 3 min. 15 sec. |
| Stabilizing bath | 1 min. 30 sec. |

The treating liquors employed in each step had the following compositions:

| | |
|---|---|
| Composition of color forming developer | |
| 4-Amino-3-methyl-N—ethyl-N—(β-hydroxyethyl-aniline sulfate | 4.75 g |
| Anhydrous sodium sulfite | 4.25 g |
| Hydroxyamine.½ sulfate | 2.0 g |
| Anhydrous potassium carbonate | 37.5 g |
| Sodium bromide | 1.3 g |
| Trisodium nitriloacetate (monohydrate) | 2.5 g |
| Potassium hydroxide | 1.0 g |
| Water was added to one liter, and the solution adjusted to pH 10.0 with the use of potassium hydroxide. | |
| Composition of bleaching solution | |
| Ethylenediaminetetraacetic acid iron ammonium salt | 100.0 g |
| Ethylenediaminetetraacetic acid di-ammonium salt | 10.0 g |
| Ammonium bromide | 150.0 g |
| Glacial acetic acid | 10.0 ml |
| Water was added to one liter, and the solution adjusted to pH 6.0. | |
| Composition of fixing solution | |
| Ammonium thiosulfate (50% aqueous solution) | 162 ml |
| Anhydrous sodium sulfite | 12.4 g |
| Water was added to one liter, and the solution adjusted to pH 6.5 with the use of acetic acid. | |
| Composition of stabilizing solution | |
| Formalin (37% aqueous solution) | 5.0 ml |
| Konidax (produced by Konishiroku Photo Industry Co., Ltd.) | 7.5 ml |
| Water was added to one liter. | |

TABLE 1

| Sample No. | Compound | Quantity added (mole/Ag mole × 100) | Sensitivity | Gamma | Maximum color forming density | Graininess |
|---|---|---|---|---|---|---|
| 1 | Blank | — | 100 | 1.15 | 1.84 | 62 |
| 2 | Compound-2 | 0.5 mole % | 76 | 0.72 | 1.45 | 38 |
| 3 | Compound-3 | 0.5 mole % | 75 | 0.71 | 1.42 | 38 |
| 4 | Compound-8 | 0.5 mole % | 72 | 0.69 | 1.41 | 36 |
| Comparative sample-1 | Comparative compound-1 | 0.5 mole % | 90 | 1.08 | 1.73 | 57 |
| Comparative sample-2 | Comparative compound-2 | 0.5 mole % | 76 | 0.72 | 1.43 | 40 |
| Comparative sample-3 | Comparative compound-3 | 0.5 mole % | 83 | 0.85 | 1.59 | 49 |

For the same sample, the tests were conducted in different ways, one being untreated and the other being stored at 60° C. under a relative humidity of 80% for 2 days, and light exposure was effected at the same time, followed by similar developing treatment steps, to give the results as shown in Table 2.

TABLE 2

| | On the day when prepared | | | 60° C., 80% RH, 2H | | |
|---|---|---|---|---|---|---|
| Sample No. | Sensitivity | Fog | Maximum color forming density | Sensitivity | Fog | Maximum color forming density |
| 1 | 100 | 0.24 | 1.84 | 94 | 0.29 | 1.76 |
| 2 | 76 | 0.19 | 1.45 | 74 | 0.20 | 1.40 |
| 3 | 75 | 0.18 | 1.42 | 72 | 0.20 | 1.37 |
| 4 | 72 | 0.17 | 1.41 | 70 | 0.19 | 1.36 |
| Comparative sample-1 | 90 | 0.22 | 1.73 | 88 | 0.28 | 1.60 |
| Comparative sample-2 | 76 | 0.19 | 1.43 | 59 | 0.19 | 1.20 |
| Comparative sample-3 | 83 | 0.21 | 1.59 | 70 | 0.20 | 1.35 |

As apparently seen from the results in Table 1 and Table 2, Comparative compound-1 has no effect of improving graininess and Comparative compound-2, while it can improve graininess, is poor in storability. As for Comparative compound-3, it does not control gamma well and consequently provides little improvement of graininess. In contrast, the compounds of the present invention are also good in storability with great gamma controlling function as well as great improvement effect of graininess.

EXAMPLE 2

On a transparent triacetate base, coatings were applied in layers in the following order.

First layer: Red sensitive emulsion layer

A solution of 10.6 g of 1-hydroxy-N-[4-(2,4-di-tertamylphenoxy)butyl]-2-naphthoamide as a cyan coupler dissolved in 11 ml of tricresyl phosphate and 30 ml of ethyl acetate was mixed with 20 ml of a 10% aqueous solution of Alkanol B (alkylnaphthalene sulfonate, produced by Du Pont de Nemours & Co.) and 200 ml of a 5% aqueous gelatin solution, followed by emulsifying dispersion, to obtain an emulsion (I). Then, the dispersion was added to 1 kg of a red sensitive silver iodobromide emulsion (containing 6 mole% of silver iodide), and 40 ml of a 2% solution of 1,2-bis(vinylsulfonyl)ethane (in water:methanol=1:1) was added as film hardener to the resulting mixture. The mixture was then coated and dried on the base (coated silver quantity 20 mg/dm$^2$).

Second layer: Intermediate layer

Gelatin intermediate layer containing 0.5 g/m$^2$ of gelatin and 0.1 g/m$^2$ of 2,5-di-tert-octylhydroquinone.

Third layer: Green sensitive emulsion layer

As a magenta coupler, 15 g of 1-(2,4,6-trichlorophenyl)-3-[3-(2,4-di-tert-amylphenoxyacetamido)benzamido]-5-pyrazolone was dissolved in 15 g of tricresyl phosphate and 45 ml of ethyl acetate, and following the procedure as described in Example 1 for preparation of the emulsion (I), an emulsion (II) was prepared. The emulsion was added to 1 kg of a green sensitive silver iodobromide emulsion (containing 6 mole% silver iodide) and the same film hardner as used in the first layer in Example 1 was added, followed by coating and drying (coated silver quantity: 20 mg/dm$^2$).

Fourth layer: Protective layer

Gelatin layer containing 0.5 g/m$^2$ of gelatin.

The thus prepared sample is called as Sample-(1), and in the oil component in the third layer in Sample-(1), there were incorporated the DIR compounds as shown in Table 3 in amounts, which are also prescribed therein, to prepare emulsified dispersions similarly as in preparation of the emulsion (II).

The thus prepared samples were subjected to wedge exposure to green light and thereafter subjected to uniform exposure to red light at a dosage so that the red density may be 2.0 only by exposure to red light, followed by the developing treatment similarly as in Example 1, to obtain the results as shown in Table 3.

IIE (interlayer effect) in Table 3 was determined as follows. Although the red sensitive layer is subjected to uniform exposure so that D=2.0, the red density is decreased by inhibited development of the red sensitive layer corresponding to the concentration to be developed in the green sensitive layer, namely corresponding to the inhibitor released, due to IIE. The degree of such a decrease is determined as IIE, namely:

$$IIE=(2.0-D_1)/2.0\times 100$$

Thus, as this value is greater, the interlayer effect is stronger to improve color reproducibility.

TABLE 3

| Sample No. | Compound | Quantity added (mole/Ag mole × 100) | Gamma of green sensitive layer | IIE |
|---|---|---|---|---|
| 1 | None | — | 1.35 | 5 |
| 2 | Compound-1 | 0.5 mole % | 0.88 | 18 |
| 3 | Compound-2 | 0.5 mole % | 0.82 | 20 |
| 4 | Compound-5 | 0.5 mole % | 0.85 | 18 |
| 5 | Comparative compound-1* | 1.5 mole % | 1.00 | 5 |
| 6 | Comparative compound-2* | 0.5 mole % | 0.82 | 6 |
| 7 | Comparative compound-1 in Example 1 | 1.5 mole % | 1.25 | 7 |

*Comparative compound-1

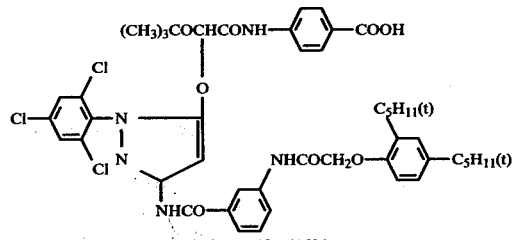

Compound in Research Disclosure No. 19536
*Comparative compound-2

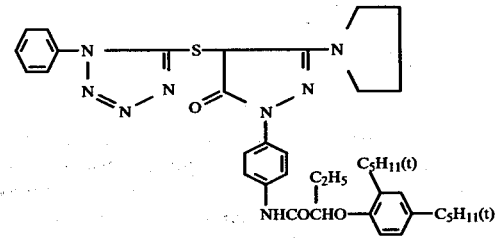

As apparently seen from the results as shown in Table 3, the compound according to the present invention has good interlayer effect, as contrasted to Comparative compound-1 and Comparative compound-1 in Example 1, with structures similar to that of the compound of the present invention, having substantially no interlayer effect.

EXAMPLE 3

On a triacetate film base having a halation preventive layer, there was coated and dried a silver halide emulsion having the same composition as the third layer in Example 2, incorporating as emulsified dispersion similar to the emulsion (II) in Example 2 of the same magenta coupler as used in the third layer of Example 2 to prepare Sample 1. Other samples were also prepared by use of the compounds and amounts as indicated in Table 4.

These samples were subjected to exposure to green light through a wedge in which the space frequency was changed from 3/mm to 100/mm, and the developing treatment was conducted similarly as in Example 1. MTF (Modulation Transfer Function) of the resulting color image was determined by a green light, and a comparison was made as to the magnitude of MTF at a space frequency of 10/mm and 30/mm for examination of the improvement effect of sharpness. The results are listed in Table 4.

TABLE 4

| Sample No. | Compound | Quantity added (mole/Ag mole × 100) | Gamma | MTF values 10/mm | MTF values 30/mm |
|---|---|---|---|---|---|
| 1 | — | — | 1.34 | 98 | 60 |
| 2 | Compound-1 | 0.5 mole % | 0.87 | 128 | 82 |
| 3 | Compound-2 | 0.5 mole % | 0.87 | 126 | 84 |
| 4 | Compound-4 | 0.5 mole % | 0.82 | 130 | 86 |
| 5 | Compound-9 | 0.5 mole % | 0.81 | 130 | 85 |
| 6 | Comparative compound-1 in Example 2 | 1.5 mole % | 1.12 | 110 | 73 |
| 7 | Comparative compound-1 in Example 1 | 1.5 mole % | 1.13 | 103 | 70 |

As apparently seen from Table 4, the compounds of the present invention have good effects of improved sharpness.

When the above examples were applied for so-called false color negative films, wherein the photosensitive wavelength region in the emulsion layer and the absorption wavelength region for the dyestuff formed from the coupler contained in the emulsion layer are not in a complementary color relation to each other, there were obtained substantially the same results.

We claim:

1. A silver halide photosensitive color photographic material comprising a coupler of the formula

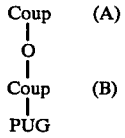

wherein Coup (A) is a non-diffusion type coupling component (A) bonded to the oxygen atom at a position which enables Coup (A) to form a colored or colorless compound as a result of coupling with and releasing from an oxidized color developing agent, Coup (B) is a diffusion type coupling component (B) which is bonded to the oxygen atom in a position which enables Coup (B) to split off from said Coup (A) and form a coupling reaction product with said oxidized color developing agent, and PUG is a development inhibitor which is released when Coup (B) undergoes said coupling reaction.

2. The silver halide photosensitive color photographic material of claim 1, wherein said Coup (A) and Coup (B) are each selected from residues of yellow, cyan and magenta couplers.

3. The silver halide photosensitive color photographic material of claim 2, wherein said Coup (A) and Coup (B) are each residues of yellow couplers selected from the group consisting of acetoanilide group containing yellow couplers and pivaloyl acetoanilide group containing yellow couplers.

4. The silver halide photosensitive color photographic material of claim 2, wherein said Coup (A) and Coup (B) are each residues of magenta couplers selected from the group consisting of pyrazolone group containing magenta couplers and indazolone group containing magenta couplers.

5. The silver halide photosensitive color photographic material of claim 2, wherein said Coup (A) and Coup (B) are each residues of cyan couplers selected from the group consisting of naphthol group containing couplers and phenol group containing couplers.

6. The silver halide photosensitive color photographic material of claim 1, wherein said coupler is selected from the group consisting of (a)

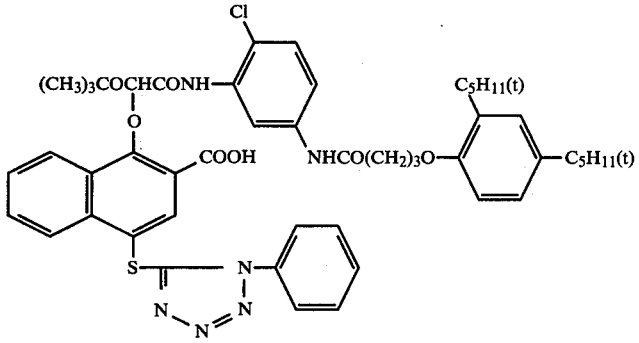

(b)

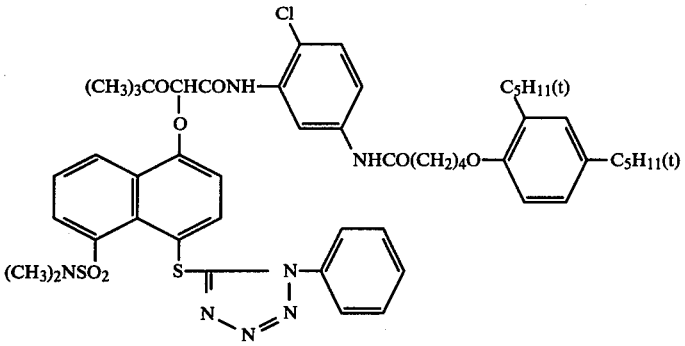

-continued
(c)
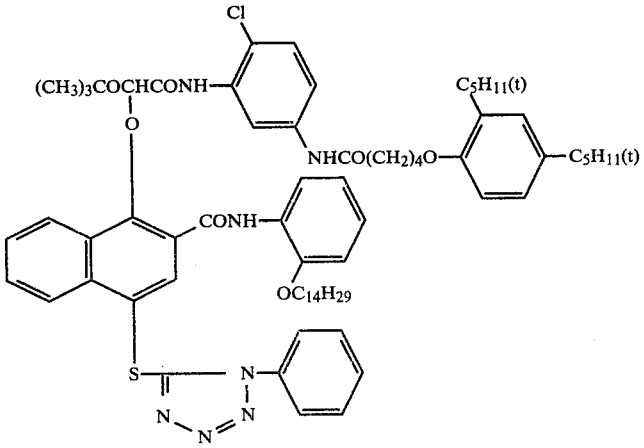
(d)
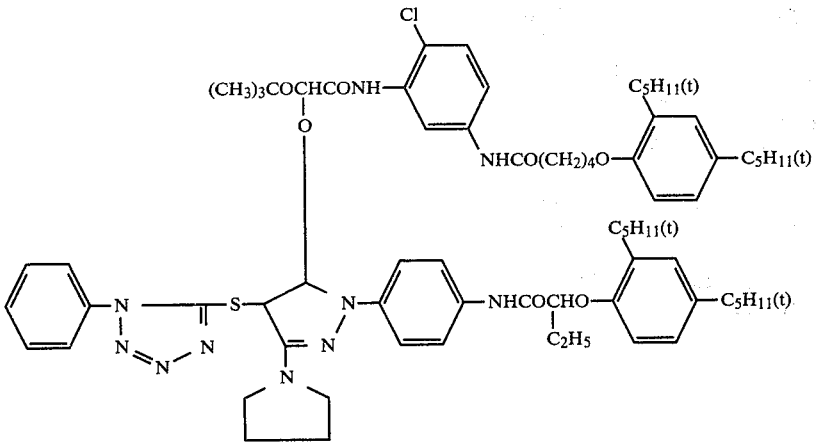
(e)
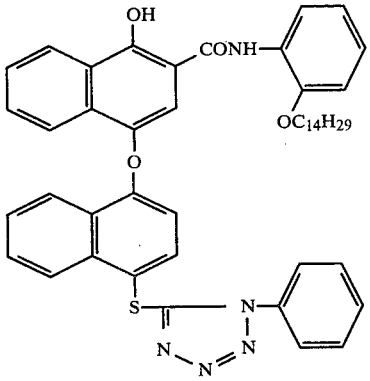
(f)
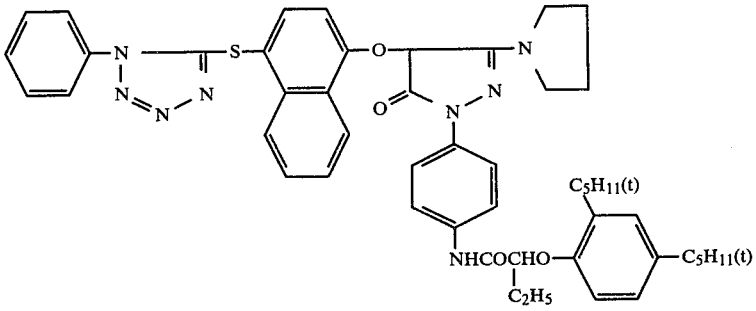
7. The silver halide photosensitive color photographic material of claim 1, wherein said development inhibitor is selected from those containing a mercaptotetrazole group, a selenotetrazole group, a mercaptobenzothiazole group, a selenobenzothiazole group, a mercaptobenzoxazole group, a mercaptobenzimidazole group, a selenobenzimidazole group, a benzotriazole group, a benzodiazole group and an iodine atom.

8. The silver halide photosensitive color photographic material of claim 1, wherein said material further comprises a support having thereon at least one emulsion selected from the group consisting of a red sensitive silver halide emulsion, a green sensitive silver halide emulsion, and a blue sensitive silver halide emulsion.

9. The silver halide photosensitive color photographic material of claim 8, wherein said emulsion is applied in more than one layer.

* * * * *